US010103442B2

(12) United States Patent
Huang et al.

(10) Patent No.: US 10,103,442 B2
(45) Date of Patent: Oct. 16, 2018

(54) ANTENNA STRUCTURE

(71) Applicant: ARCADYAN TECHNOLOGY CORPORATION, Hsinchu (TW)

(72) Inventors: Chih-Yung Huang, Hsinchu (TW); Kuo-Chang Lo, Hsinchu (TW)

(73) Assignee: Arcadyan Technology Corporation, Hsinchu (TW)

( * ) Notice: Subject to any disclaimer, the term of this patent is extended or adjusted under 35 U.S.C. 154(b) by 125 days.

(21) Appl. No.: 15/224,058

(22) Filed: Jul. 29, 2016

(65) Prior Publication Data

US 2017/0085002 A1 Mar. 23, 2017

(30) Foreign Application Priority Data

Sep. 22, 2015 (TW) ..... 104131323 A

(51) Int. Cl.

| | |
|---|---|
| ***H01Q 1/38*** | (2006.01) |
| ***H01Q 9/28*** | (2006.01) |
| ***H01Q 1/48*** | (2006.01) |
| ***H01Q 21/24*** | (2006.01) |
| ***H01Q 9/26*** | (2006.01) |

(52) U.S. Cl.

CPC ..... *H01Q 9/285* (2013.01); *H01Q 1/38* (2013.01); *H01Q 1/48* (2013.01); *H01Q 9/26* (2013.01); *H01Q 21/245* (2013.01)

(58) Field of Classification Search

CPC ..... H01Q 1/38; H01Q 9/285; H01Q 1/48; H01Q 21/24

USPC ..... 343/700 MS

See application file for complete search history.

(56) References Cited

U.S. PATENT DOCUMENTS

| | | | | |
|---|---|---|---|---|
| 7,098,863 | B2 * | 8/2006 | Bancroft | H01P 5/10 343/700 MS |
| 7,265,717 | B2 * | 9/2007 | Saitou | H01Q 1/38 343/700 MS |
| 2004/0012529 | A1 * | 1/2004 | Teshirogi | G01R 29/0821 343/702 |
| 2005/0035919 | A1 * | 2/2005 | Yang | H01Q 1/38 343/795 |
| 2005/0146480 | A1 * | 7/2005 | Yazdandoost | H01Q 9/285 343/795 |

FOREIGN PATENT DOCUMENTS

| | | |
|---|---|---|
| CN | 1682408 A | 10/2005 |
| CN | 1787285 A | 6/2006 |
| CN | 101083351 | 12/2007 |

OTHER PUBLICATIONS

Examination report Taiwanese Patent Application No. 104131323 prepared by the Taiwanese Patent Office, dated Aug. 15, 2016, and partial English translation thereof. (6 pages).

* cited by examiner

*Primary Examiner* — Huedung Mancuso
(74) *Attorney, Agent, or Firm* — Haynes and Boone, LLP

(57) ABSTRACT

An antenna structure is disclosed. The antenna structure includes a signal-feeding terminal; a first radiating conductor extending from the signal-feeding terminal along a first direction to include a first gradually widening path; a ground terminal configured to be separated from the signal-feeding terminal by a first gap; and a second radiating conductor extending from the ground terminal along a second direction perpendicular to the first direction to include a second gradually widening path.

20 Claims, 4 Drawing Sheets

ANTENNA STRUCTURE

CROSS-REFERENCE TO RELATED APPLICATION AND CLAIM OF PRIORITY

The application claims the benefit of Taiwan Patent Application No. 104131323, filed on Sep. 22, 2015, at the Taiwan Intellectual Property Office, the disclosure of which is incorporated herein in its entirety by reference.

FIELD OF THE INVENTION

The present invention is related to an antenna structure, and more particularly to a dipole antenna structure having dual-polarization performance.

BACKGROUND OF THE INVENTION

Conventional dipole antennas and RF devices both use a unipolar antenna structure. Such an antenna structure not only occupies space, but also has to change its placement position when applied to different systems having different polarization requirements (e.g. a system preferring to receive a horizontal polarization signal or preferring to receive a vertical polarization signal). In addition, when such an antenna structure is used in an indefinite environment, i.e. in an environment where whether the vertical signal is strong or the horizontal signal is strong is unknown, it is prone to poor reception or transmission.

In order to overcome the drawbacks in the prior art, an antenna structure is disclosed. The particular design in the present invention not only solves the problems described above, but also is easy to implement. Thus, the present invention has utility for the industry.

SUMMARY OF THE INVENTION

The antenna structure having dual-polarization performance of the present invention not only can be applied to different systems, but also does not need to meet different polarization requirements by reversing its direction. In short, because the antenna structure of the present invention simultaneously has the vertical polarization and the horizontal polarization functions, even if it is used in an indefinite environment, the reception and transmission functions can also be easily achieved, which is suitable for various wireless transmission devices. In addition, the antenna structure of the present invention not only can omit the additional ground terminal required for a conventional antenna, but it also can be placed anywhere in the system, which is not limited to the limitation of connecting to the system ground.

In accordance with one aspect of the present invention, an antenna structure is disclosed. The antenna structure includes a signal-feeding terminal; a first radiating conductor extending from the signal-feeding terminal along a first direction, and having a first width, a second width and a third width sequentially spaced from the signal-feeding terminal along the first direction and measured in a direction perpendicular to the first direction; a ground terminal configured to be separated from the signal-feeding terminal by a first gap; and a second radiating conductor extending from the ground terminal along a second direction perpendicular to the first direction, and having a fourth width, a fifth width and a sixth width sequentially spaced from the ground terminal along the second direction and measured in a direction parallel to the first direction, wherein the first width is smaller than the second width, the fifth width is smaller than the fourth width, a first ratio of the second width to the third width is between 0.75 and 0.8, and a second ratio of the fifth width to the sixth width is between 0.75 and 0.8.

In accordance with another aspect of the present invention, an antenna structure is disclosed. The antenna structure includes a signal-feeding terminal; a first radiating conductor extending from the signal-feeding terminal along a first direction to a first position, and gradually widening from the signal-feeding terminal along the first direction; a ground terminal configured to be separated from the signal-feeding terminal by a first gap; a second radiating conductor extending from the ground terminal along a second direction perpendicular to the first direction, narrowing to a second position, and then gradually widening from the second position along the second direction to a third position; and a conductor extending portion extending from the ground terminal along the first direction to a fourth position.

In accordance with a further aspect of the present invention, an antenna structure is disclosed. The antenna structure includes a signal-feeding terminal; a first radiating conductor extending from the signal-feeding terminal along a first direction to include a first gradually widened path; a ground terminal configured to be separated from the signal-feeding terminal by a first gap; and a second radiating conductor extending from the ground terminal along a second direction perpendicular to the first direction to include a second gradually widened path.

The above objectives and advantages of the present invention will become more readily apparent to those ordinarily skilled in the art after reviewing the following detailed descriptions and accompanying drawings, in which:

DETAILED DESCRIPTION OF THE PREFERRED EMBODIMENTS

The present invention will now be described more specifically with reference to the following embodiments. It is to be noted that the following descriptions of preferred embodiments of this invention are presented herein for the purposes of illustration and description only; they are not intended to be exhaustive or to be limited to the precise form disclosed.

The present invention is a printed dipole antenna structure used for a substrate (e.g. the printed circuit board, PCB), wherein the antenna structure is formed by printing a metal conductor on one surface of the substrate, and connecting a signal-feeding terminal and a ground terminal to the metal conductor. In addition, the ground metal is not printed in the position on the other surface of the substrate corresponding to the metal conductor. The substrate can be a multi-layer substrate or a metal-free single-layer substrate.

The antenna structure of the present invention includes a signal-feeding terminal, a first radiating conductor, a ground terminal and a second radiating conductor, wherein the length of the first radiating conductor and that of the second radiating conductor are approximately equal to a half of the resonant wavelength of the usable frequency in the frequency range to be designed. That is to say, the present invention can control the operating frequency of the antenna structure by adjusting the lengths of the first radiating conductor and the second radiating conductor.

Figures 1A, 1B:
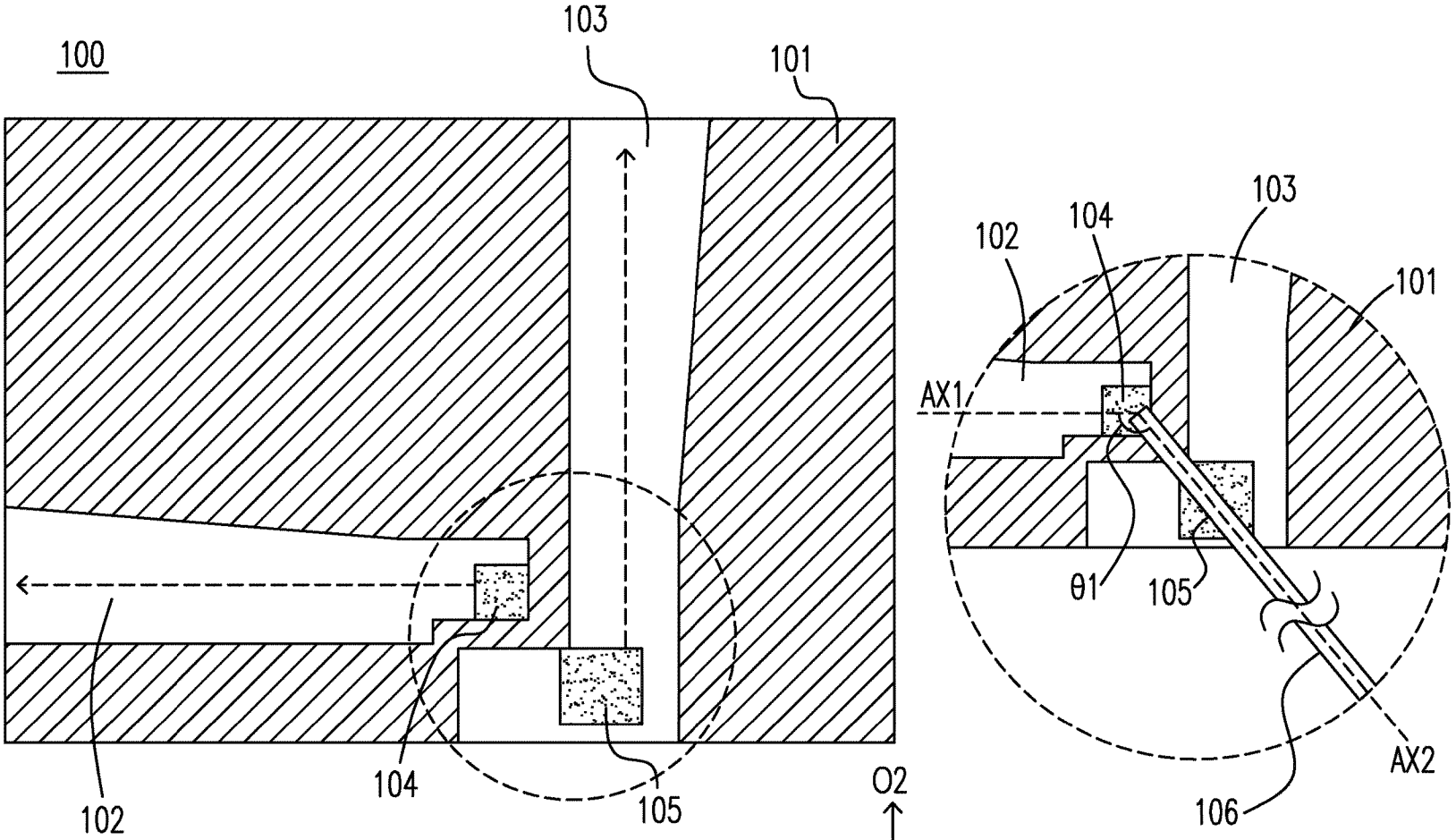
FIGS. 1(*a*) and 1(*b*) show an antenna structure according to a first embodiment of the present invention.

Please refer to FIGS. 1(*a*) and 1(*b*), which show an antenna structure 100 according to a first embodiment of the present invention. As shown in FIGS. 1(*a*) and 1(*b*), the present invention discloses the antenna structure 100 printed on a substrate 101. The antenna structure 100 includes a signal-feeding terminal 104, a first radiating conductor 102 extending from the signal-feeding terminal 104 along a first direction O1, a ground terminal 105 adjacent to the signal-feeding terminal 104, and a second radiating conductor 103 extending from the ground terminal 105 along a second direction O2 perpendicular to the first direction O1, wherein the first radiating conductor 102 and the second radiating conductor 103 are trapezoidal.

The signal-feeding terminal 104 is connected to the ground terminal 105 via a cable, wherein the cable 106 has a feed-in cable connecting reference line AX2, and the first radiating conductor 102 has a conductor extending path reference line AX1. The feed-in cable connecting reference line AX2 and the conductor extending path reference line AX1 have a reference angle θ1 therebetween.

According to one embodiment of the present invention, the reference angle θ1 is between 90° and 140°.

According to the best embodiment of the present invention, the reference angle θ1 is 130°.

As shown in FIGS. 1(*a*) and 1(*b*), the first radiating conductor 102 generates a current path extending along the first direction O1 (as shown by the leftward dotted arrow in FIG. 1) to receive the horizontal polarization signal, and the second radiating conductor 103 generates a current path extending along the second direction O2 (as shown by the upward dotted arrow in FIG. 1) to receive the vertical polarization signal.

Figures 2A, 2B:
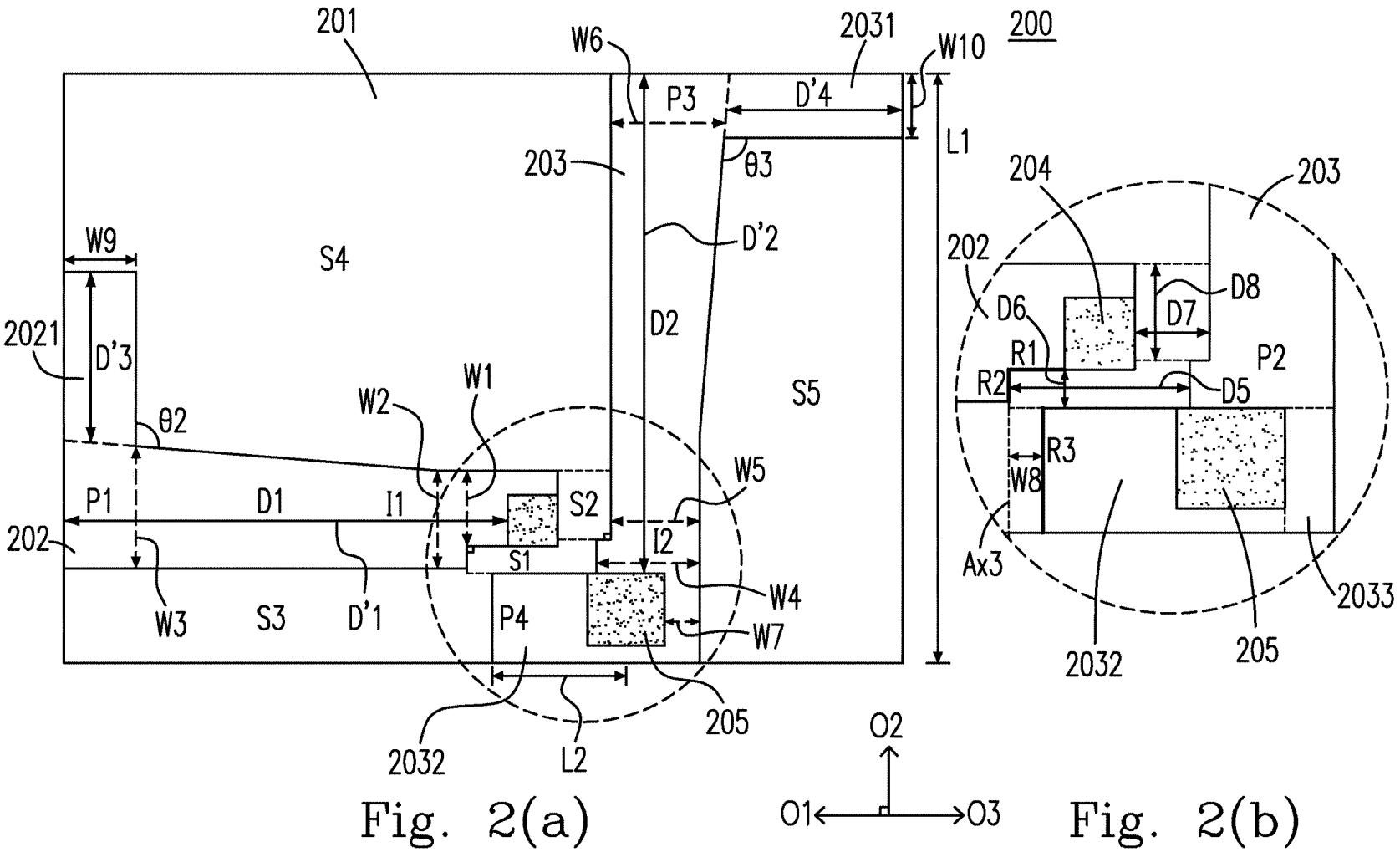
FIGS. 2(*a*) and 2(*b*) show an antenna structure according to a second embodiment of the present invention.

Please refer to FIGS. 2(*a*) and 2(*b*), which show an antenna structure 200 according to a second embodiment of the present invention. As shown in FIGS. 2(*a*) and 2(*b*), the antenna structure 200 includes a substrate 201, a signal-feeding terminal 204, a ground terminal 205, a first radiating conductor 202, a second radiating conductor 203, a first radiating conductor extending portion 2021, a second radiating conductor extending portion 2031 and a conductor extending portion 2032. The signal-feeding terminal 204, the ground terminal 205, the first radiating conductor 202, the second radiating conductor 203, the first radiating conductor extending portion 2021, the second radiating conductor extending portion 2031 and the conductor extending portion 2032 are all disposed on the substrate 201.

As shown in FIGS. 2(*a*) and 2(*b*), the first radiating conductor 202 extends from the signal-feeding terminal 204 along a first direction O1, and gradually widens from the signal-feeding terminal along the first direction O1. In addition, the first radiating conductor 202 has a first width W1 perpendicular to the first direction O1, a second width W2 adjacent to the first width W1, and a third width W3 adjacent to the second width W2. The second radiating conductor 203 extends from the ground terminal 205 along a second direction O2 perpendicular to the first direction O1, narrows to a second position P2, and then gradually widens from the second position P2 along the second direction O2 to a third position P3. In addition, the second radiating conductor 203 has a fourth width W4 parallel to the first direction O1, a fifth width W5 adjacent to the fourth width W4, and a six width W6 adjacent to the fifth width W5. Compared to the second width W2 and the third width W3, the first width W1 is more adjacent to the signal-feeding terminal 204. Compared to the fifth width W5 and the sixth width W6, the fourth width W4 is more adjacent to the ground terminal 205. The first width W1 is smaller than the second width W2, the second width W2 is smaller than the third width W3, and the fifth width W5 is smaller than the fourth width W4 and the sixth width W6. The ratio of the second width W2 to the third width W3 is between 0.75 and 0.8, and the ratio of the fifth width W5 to the sixth width W6 is between 0.75 and 0.8. The third width W3 is approximately equal to the sixth width W6, and the second width W2 is approximately equal to the fourth width W4.

According to an embodiment of the present invention, the conductor extending portion 2032 further includes a conductor extending sub-portion 2033 extending from the ground terminal 205 along a third direction O3 opposite to the first direction O1. The conductor extending sub-portion 2033 has a seventh width W7 being one-third of the sixth width W6.

According to another embodiment of the present invention, the seventh width W7 is at least one-third of the sixth width W6 or less.

Moreover, the conductor extending portion 2032 further has a third edge R3. The third edge R3 and a vertical extending reference line AX3 for a second edge R2 of the first radiating conductor 202 have an eighth width W8 therebetween. The eighth width W8 is at least equal to or larger than the sixth width W6.

The first radiating conductor 202 gradually widens from the signal-feeding terminal 204 along the first direction O1, and extends to a first position P1. The ground terminal 205 is configured to be separated from the signal-feeding terminal 204 by a first gap S1. The second radiating conductor 203 extends from the ground terminal 205 along the second direction O2, narrows to the second position P2, and then gradually widens from the second position P2 along the second direction O2 to a third position P3. The conductor extending portion 2032 extends from the ground terminal 205 along the first direction O1 to the third position P3. The first radiating conductor 202 and the second radiating conductor 203 are trapezoidal and electrically insulated from each other.

As shown in FIGS. 2(*a*) and 2(*b*), the substrate 201 has a length L1, and there is a length L2 between the center of the ground terminal 205 and the fourth position P4 of the conductor extending portion 2032, wherein the length L2 is smaller than one-third of the length L1 or more.

According to an embodiment of the present invention, the length L2 is one-fifth of the length L1.

In addition, the first radiating conductor 202 includes a first initial extending portion I1 adjacent to the signal-feeding terminal 204, and a first path portion D1 between the first initial extending portion I1 and the first position P1. The second radiating conductor 203 includes a second initial extending portion I2 adjacent to the ground terminal 205, and a second path portion D2 between the second initial extending portion I2 and the third position P3. The first radiating conductor 202 has a first edge R1 adjacent to the conductor extending portion 2032. The first path portion D1 has a second edge R2 adjacent to the first edge R1. The first gap S1 is formed among the second edge R2, the first edge R1, the second initial extending portion I2, the ground terminal 205 and the conductor extending portion 2032. The area of the first path portion D1 is approximately equal to that of the second path portion D2.

According to one embodiment of the present invention, the first path portion D1 has at least one right-angle turn, and the second path portion D2 also has at least one right-angle turn.

The antenna structure 200 further includes a first radiating conductor extending portion 2021 and a second radiating conductor extending portion 2031, wherein the first radiating conductor extending portion 2021 extends from the first position P1 along the second direction O2, and the second radiating conductor extending portion 2031 extends from the third position P3 along a third direction O3 opposite to the first direction O1. The first radiating conductor 202 and the first radiating conductor extending portion 2021 have a first bend therebetween, wherein the first bend has a first inner angle θ2. The second radiating conductor 203 and the second radiating conductor extending portion 2031 have a second bend therebetween, wherein the second bend has a second inner angle θ3.

According to one embodiment of the present invention, the first inner angle Θ2 and the second inner angle θ3 are between 90° and 105°.

According to one embodiment of the present invention, the first inner angle θ2 and the second inner angle θ3 are 95°.

The first radiating conductor extending portion 2021 has a ninth width W9, and the second radiating conductor extending portion 2031 has a tenth width W10. The ninth width W9 is approximately equal to the tenth width W10, and the ninth width W9 and the tenth width W10 are both smaller than the first width W1 and the fifth width W5.

In addition, the first radiating conductor 202 has a first length D'1, and the second radiating conductor 203 has a second length D'2, wherein the first length D'1 is equal to the second length D'2. The first radiating conductor extending portion 2021 has a third length D'3, and the second radiating conductor extending portion 2031 has a fourth length D'4, wherein the third length D'3 is equal to the fourth length D'4. The first length D'1, the second length D'2, the third length D'3 and the fourth length D'4 determine the operating frequency of the antenna structure 200.

According to one embodiment of the present invention, the third length D'3 is one-third of the first length D'1, and the fourth length D'4 is one-third of the second length D'2.

Moreover, in addition to the first gap S1 for adjusting the impedance matching of the antenna structure 200, the antenna structure 200 further includes a second gap S2, a third gap S3, a fourth gap S4 and a fifth gap S5. The second gap S2 is formed among the second radiating conductor 203, the first radiating conductor 202 and the signal-feeding terminal 204, and communicates with the first gap S1. The third gap S3 is formed between the first radiating conductor 202 and the fourth position P4, and communicates with the first gap S1. The fourth gap S4 is formed among the second radiating conductor 203, the first radiating conductor 202 and the first radiating conductor extending portion 2021, and communicates with the second gap S2. The fifth gap S5 is formed between the second radiating conductor 203 and the second radiating conductor extending portion 2031.

The second radiating conductor 203 is perpendicular to the conductor extending portion 2032 and parallel to the first radiating conductor extending portion 2021. The first radiating conductor 202 is parallel to the second radiating conductor extending portion 2031. The first radiating conductor extending portion 2021 is parallel to the second radiating conductor 203. The second radiating conductor extending portion 2031 is parallel to the first radiating conductor 202. The first radiating conductor 202 is trapezoidal and includes a first gradually widening path, and the second radiating conductor 203 is trapezoidal and includes a second gradually widening path. The conductor extending portion 2032, the first radiating conductor extending portion 2021 and the second radiating conductor extending portion 2031 are all quadrilateral.

The first gap S1 has a first distance D5 between the second edge R2 and the second initial extending portion I2, and a second distance D6 between the conductor extending portion 2032 and the first edge R1. The second gap S2 has a third distance D7 between the signal-feeding terminal 204 and the second radiating conductor 203, and a fourth distance D8. The second distance D6 is smaller than the first distance D5, the third distance D7 is smaller than the fourth distance D8, the second distance D6 is smaller than the fourth distance D8, and the third distance D7 is smaller than the first distance D5.

According to one embodiment of the present invention, the second distance D6 is approximately equal to one-sixth of the first distance D5.

According to one embodiment of the present invention, a first ratio of the third distance D7 to the first distance D5 is 1/3, and a second ratio of the second distance D6 to the fourth distance D8 is also 1/3.

In addition, it can also be seen from FIGS. 2(*a*) and 2(*b*) that the first radiating conductor 202 generates a current path (not shown) extending along the first direction O1, and the first radiating conductor extending portion 2021 generates a current path (not shown) extending along the second direction O2. The first radiating conductor 202 and the first radiating conductor extending portion 2021 are used to receive the horizontal polarization signal. The second radiating conductor 203 generates a current path (not shown) extending along the second direction O2, and the second radiating conductor extending portion 2031 generates a current path (not shown) extending along the third direction O3. The second radiating conductor 203 and the second radiating conductor extending portion 231 are used to receive the vertical polarization signal.

Figure 3:
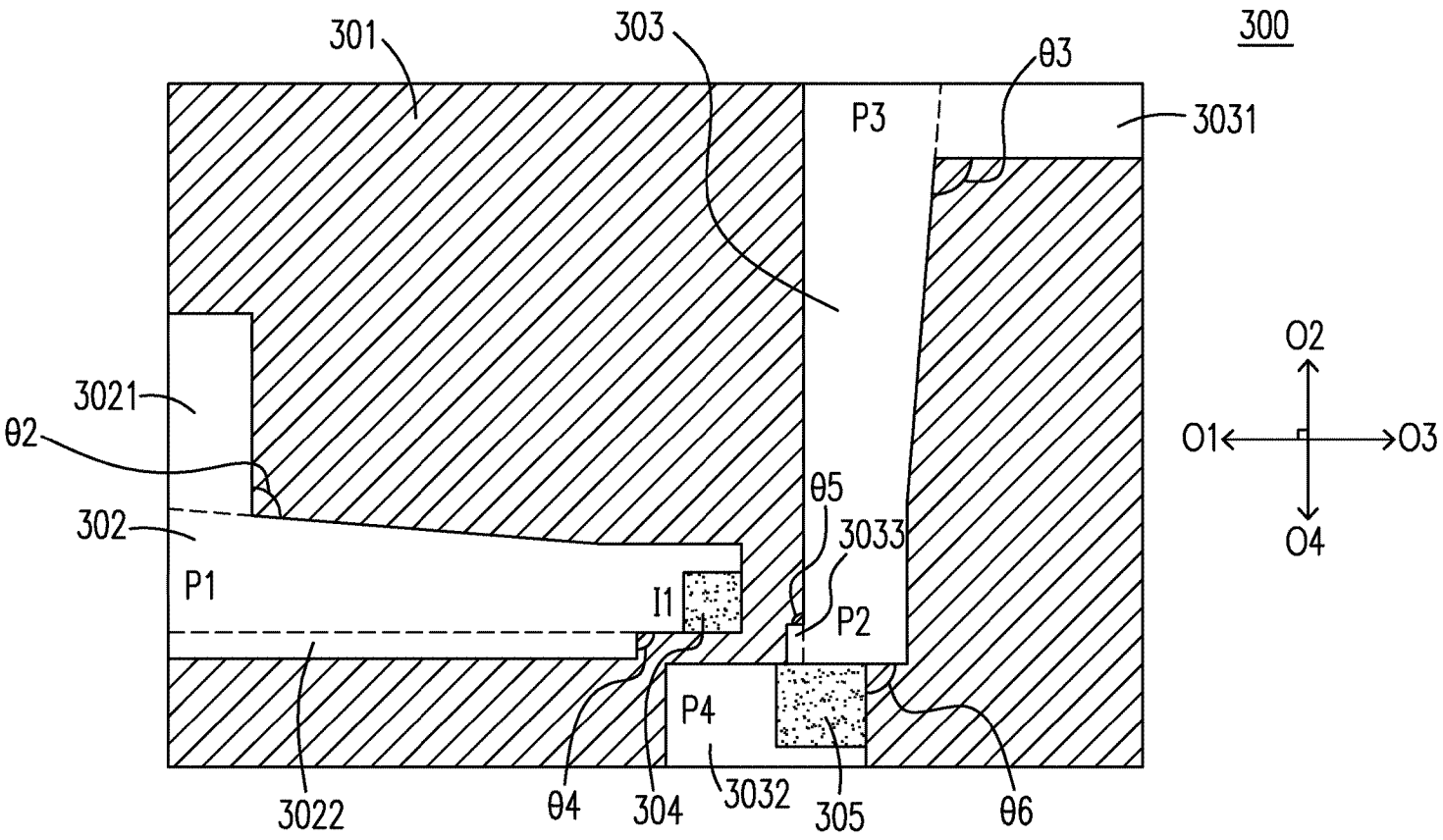
FIG. 3 shows an antenna structure according to a third embodiment of the present invention.

Please refer to FIG. 3, which shows an antenna structure 300 according to a third embodiment of the present invention. The antenna structure 300 includes a substrate 301, a signal-feeding terminal 304, a ground terminal 305, a first radiating conductor 302, a second radiating conductor 303, a first radiating conductor extending portion 3021, a first conductor extending portion 3022, a second radiating conductor extending portion 3031, a second conductor extending portion 3032 and a conductor extending sub-portion 3033. The signal-feeding terminal 304, the ground terminal 305, the first radiating conductor 302, the second radiating conductor 303, the first radiating conductor extending portion 3021, the first conductor extending portion 3022, the second radiating conductor extending portion 3031, the second conductor extending portion 3032 and the conductor extending sub-portion 3033 are all disposed on the substrate 301.

The antenna structure 300 includes a signal-feeding terminal 304, a first radiating conductor 302, a ground terminal 305, a second radiating conductor 303 and a conductor extending portion 3032. The first radiating conductor 302 gradually widens from the signal-feeding terminal 304 along a first direction O1, and extends from a first initial extending portion I1 to a first position P1. The ground terminal 305 is configured to be separated from the signal-feeding terminal 304 by a gap S. The second radiating conductor 303 extends from the ground terminal 305 along a second direction O2 perpendicular to the first direction O1, narrows to a second position P2, and then gradually widens from the second position P2 along the second direction O2 to a third direction P3. The conductor extending portion 3032 extends from the ground terminal 305 along the first direction O1 to a fourth position P4. The first radiating conductor 302 and the second radiating conductor 303 are trapezoidal.

The first radiating conductor extending portion 3021 extends from the first position P1 along the second direction O2, and the second radiating conductor extending portion 3031 extends from the third position P3 along a third direction O3 opposite to the first direction O1. The first radiating conductor 302 and the first radiating conductor extending portion 3021 have a first bend therebetween, wherein the first bend has a first inner angle θ2. The second radiating conductor 303 and the second radiating conductor extending portion 3031 have a second bend therebetween, wherein the second bend has a second inner angle θ3.

According to one embodiment of the present invention, the first inner angle θ2 and the second inner angle θ3 are between 90° and 105°.

According to the best embodiment of the present invention, the first inner angle θ2 and the second inner angle θ3 are 95°.

The first conductor extending portion 3022 extends from the first radiating conductor 302 along a fourth direction O4 opposite to the second direction O2. The first conductor extending portion 3022 and the first radiating conductor 32 have a third bend therebetween, wherein the third bend has a third inner angle θ4. The first conductor extending portion 3022 is a rectangle.

The conductor extending sub-portion 3033 extends from the second radiating conductor 303 along the first direction O1. The conductor extending sub-portion 3033 and the second radiating conductor 303 have a fourth bend therebetween, wherein the fourth bend has a fourth inner angle θ5. The conductor extending sub-portion 3033 is also a rectangle.

According to the best embodiment of the present invention, the third inner angle θ4 and the fourth inner angle θ5 are 90°.

In addition, it can also be seen from FIG. 3 that the conductor extending portion 3032, the ground terminal 305 and the second radiating conductor 303 have a fifth bend thereamong, wherein the fifth bend has a fifth inner angle θ6 and is at least equal to or larger than 90°.

According to the best embodiment of the present invention, the fifth inner angle θ6 is 90°.

The first radiating conductor 302, the first radiating conductor extending portion 3021 and the first conductor extending portion 3022 are used to receive the horizontal polarization signal. The second radiating conductor 303, the conductor extending sub-portion 3033 and the second radiating conductor extending portion 3031 are used to receive the vertical polarization signal.

Figure 4C:
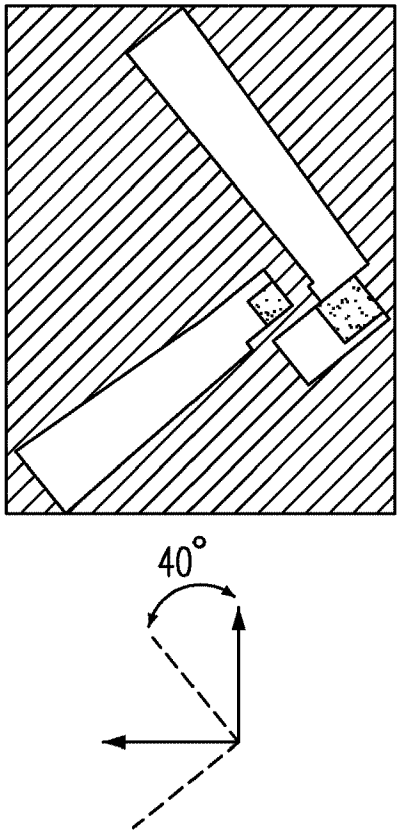
FIGS. 4(*a*)-4(*c*) show the antenna structure of FIG. 3 rotated at different angles.
Figure 4B:
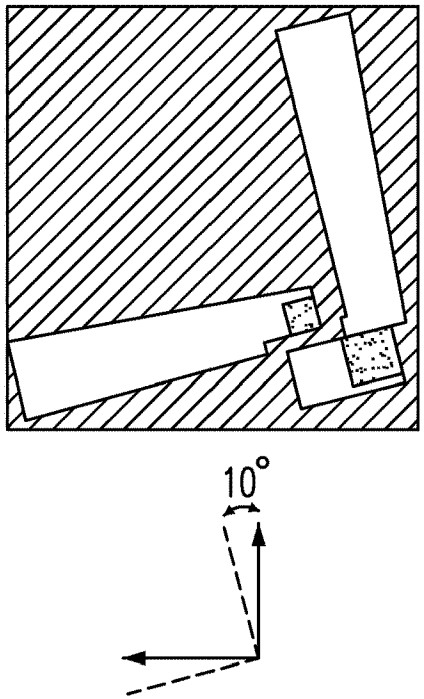
Figure 4A:
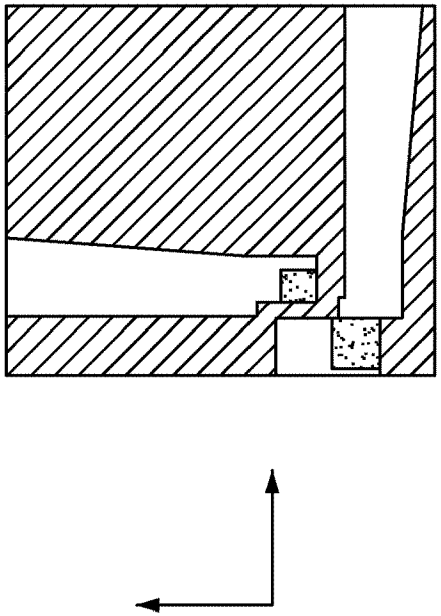

Please refer to FIGS. 4(*a*)-4(*c*), which show the antenna structure 300 of FIG. 3 rotated at different angles. As shown in FIGS. 4(*a*)-4(*c*), the amount of the horizontal polarization signal and that of the vertical polarization signal which can be received by the antenna structure 300 are adjusted by changing the angle of the antenna structure 300. FIG. 4(*a*) shows the antenna structure 300 of FIG. 3, which has the ability to receive 50% of the horizontal polarization signal and 50% of the vertical polarization signal. FIGS. 4(*b*) and 4(*c*) show that the antenna structure 300 of FIG. 3 is rotated leftward at 10° and 40° respectively to change the ratio of the horizontal polarization signal to the vertical polarization signal which can be simultaneously received by the antenna structure 300. In this way, the ratio of the horizontal polarization signal to the vertical polarization signal in different environments or applications can be easily adjusted.

In summary, the present invention discloses an antenna structure, which can be easily adjusted and modified by changing the angle of the antenna structure according to the product demand (e.g. the environment with more horizontal polarization signals or that with more vertical polarization signals). In addition, the operating frequency of the antenna structure can be easily adjusted by changing the length of the radiating conductor. Moreover, the signal-feeding method for the antenna structure of the present invention is to directly solder one end of a 50 Ω cable to the signal-feeding terminal of the antenna structure, and the other end of the 50 Ω cable can be arbitrarily extended to the RF signal module terminal. The design of directly printing the antenna structure on the circuit board in the present invention not only saves the mold and assembly costs of the general three-dimensional antenna structure, but also avoids the problem that the general three-dimensional antenna structure is easily deformed.

In addition, the antenna structure of the present invention can be independently operated in the system, and its frequency band is easy to adjust. Therefore, the cost can be saved and the antenna structure of the present invention can be applied to various wireless network devices in various environments.

Moreover, because the antenna structure of the present invention simultaneously has the horizontal polarization component and the vertical polarization component, it can simultaneously receive the vertical component signal and the horizontal component signal in any direction in the system, without special placement to receive signals. In addition, the present invention can adjust the dual-polarization characteristic of the antenna structure by adjusting the angle thereof, i.e. adjusting the ratio of the required horizontal polarization component to the required vertical polarization component to simultaneously receive the vertical component signal and the horizontal component signal in any direction in the system.

Embodiments

1. An antenna structure, comprising a signal-feeding terminal; a first radiating conductor extending from the signal-feeding terminal along a first direction, and having a first width, a second width and a third width sequentially spaced from the signal-feeding terminal along the first direction and measured in a direction perpendicular to the first direction; a ground terminal configured to be separated from the signal-feeding terminal by a first gap; and a second radiating conductor extending from the ground terminal along a second direction perpendicular to the first direction, and having a fourth width, a fifth width and a sixth width sequentially spaced from the ground terminal along the second direction and measured in a direction parallel to the first direction, wherein the first width is smaller than the second width, the fifth width is smaller than the fourth width, a first ratio of the second width to the third width is between 0.75 and 0.8, and a second ratio of the fifth width to the sixth width is between 0.75 and 0.8.

2. An antenna structure, comprising a signal-feeding terminal; a first radiating conductor extending from the signal-feeding terminal along a first direction to a first position, and gradually widening from the signal-feeding terminal along the first direction; a ground terminal configured to be separated from the signal-feeding terminal by a first gap; a second radiating conductor extending from the ground terminal along a second direction perpendicular to the first direction, narrowing to a second position, and then gradually widening from the second position along the second direction to a third position; and a conductor extending portion extending from the ground terminal along the first direction to a fourth position.

3. The antenna structure of Embodiment 2, wherein the first radiating conductor includes a first initial extending portion adjacent to the signal-feeding terminal and a first path portion between the first initial extending portion and the first position.

4. The antenna structure of any one of Embodiments 2-3, wherein the second radiating conductor includes a second initial extending portion adjacent to the ground terminal and a second path portion between the second initial extending portion and the third position.

5. The antenna structure of any one of Embodiments 2-4, wherein the first radiating conductor has a first edge adjacent to the conductor extending portion; the first path portion has a second edge adjacent to the first edge; and the first gap is formed among the second edge, the first edge, the second initial extending portion, the ground terminal and the conductor extending portion.

6. The antenna structure of any one of Embodiments 2-5, wherein the signal-feeding terminal and the ground terminal have a feed-in cable connecting reference line therebetween; and the signal-feeding terminal and the first position have a conductor extending path reference line therebetween; the feed-in cable connecting reference line and the conductor extending path reference line have a reference angle therebetween; and the reference angle is between 120° and 140°.

7. The antenna structure of any one of Embodiments 2-6, further comprising a first radiating conductor extending portion extending from the first position along the second direction; and the first radiating conductor and the first radiating conductor extending portion have a first bend therebetween, wherein the first bend has a first inner angle larger than 90°.

8. The antenna structure of any one of Embodiments 2-7, further comprising a second radiating conductor extending portion extending from the third position along a third direction opposite to the first direction, wherein the second radiating conductor and the second radiating conductor extending portion have a second bend therebetween, wherein the second bend has a second inner angle larger than 90°.

9. The antenna structure of any one of Embodiments 2-8, further comprising a substrate, wherein the signal-feeding terminal, the ground terminal, the first radiating conductor, the second radiating conductor, the first radiating conductor extending portion, the second radiating conductor extending portion and the conductor extending portion are disposed on the substrate.

10. The antenna structure of any one of Embodiments 2-9, further comprising a second gap formed among the second radiating conductor, the first radiating conductor and the signal-feeding terminal, and communicating with the first gap; a third gap formed between the first radiating conductor and the fourth position, and communicating with the first gap; a fourth gap formed among the second radiating conductor, the first radiating conductor and the first radiating conductor extending portion, and communicating with the second gap; and a fifth gap formed between the second radiating conductor and the second radiating conductor extending portion.

11. The antenna structure of any one of Embodiments 2-10, wherein the second radiating conductor has a first length measured in a direction perpendicular to the conductor extending portion and parallel to the first radiating conductor extending portion; and the first radiating conductor has a second length measured in a direction parallel to the second radiating conductor extending portion.

12. The antenna structure of any one of Embodiments 2-11, wherein the conductor extending portion, the first radiating conductor extending portion and the second radiating conductor extending portion are all quadrilateral.

13. The antenna structure of any one of Embodiments 2-12, wherein the first radiating conductor extending portion has a third length; and the second radiating conductor extending portion has a fourth length.

14. The antenna structure of any one of Embodiments 2-13, wherein the third length is smaller than one-third of the first length.

15. The antenna structure of any one of Embodiments 2-14, wherein the fourth length is smaller than one-third of the second length.

16. The antenna structure of any one of Embodiments 2-15, wherein the first length, the second length, the third length and the fourth length determine an operating frequency of the antenna structure.

17. The antenna structure of any one of Embodiments 2-16, wherein the first radiating conductor has a width; the second edge and the second initial extending portion have a first distance therebetween; the conductor extending portion and the first edge have a second distance therebetween; the signal-feeding terminal and the second radiating conductor have a third distance therebetween; a first ratio of the third distance to the first distance is 1/3; and a second ratio of the second distance to the fourth distance is 1/3.

18. The antenna structure of any one of Embodiments 2-17, wherein the first radiating conductor is electrically insulated from the second radiating conductor.

19. The antenna structure of any one of Embodiments 2-18, wherein the first gap adjusts an impedance matching of the antenna structure.

20. An antenna structure, comprising a signal-feeding terminal; a first radiating conductor extending from the signal-feeding terminal along a first direction to include a first gradually widening path; a ground terminal configured to be separated from the signal-feeding terminal by a first gap; and a second radiating conductor extending from the ground terminal along a second direction perpendicular to the first direction to include a second gradually widening path.

21. The antenna structure of Embodiments 20, wherein the first and second paths are trapezoidal.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An antenna structure, comprising a signal-feeding terminal;

a first radiating conductor extending from the signal-feeding terminal along a first direction to a first position, having a first width, a second width and a third width sequentially spaced from the signal-feeding terminal along the first direction and measured in a direction perpendicular to the first direction, and including a first initial extending portion adjacent to the signal-feeding terminal and a first path portion between the first initial extending portion and the first position;

a ground terminal configured to be separated from the signal-feeding terminal by a first gap; and a second radiating conductor extending from the ground terminal along a second direction perpendicular to the first direction, and having a fourth width, a fifth width and a sixth width sequentially spaced from the ground terminal along the second direction and measured in a direction parallel to the first direction, wherein:

the first width is smaller than the second width, the fifth width is smaller than the fourth width, a first ratio of the second width to the third width is between 0.75 and 0.8, and a second ratio of the fifth width to the sixth width is between 0.75 and 0.8.

2. An antenna structure, comprising:

a signal-feeding terminal;

a first radiating conductor extending from the signal-feeding terminal along a first direction to a first position, gradually widening from the signal-feeding terminal along the first direction, and including a first initial extending portion adjacent to the signal-feeding terminal and a first path portion between the first initial extending portion and the first position;

a ground terminal configured to be separated from the signal-feeding terminal by a first gap;

a second radiating conductor extending from the ground terminal along a second direction perpendicular to the first direction, narrowing to a second position, and then gradually widening from the second position along the second direction to a third position; and a conductor extending portion extending from the ground terminal along the first direction to a fourth position.

3. The antenna structure as claimed in claim 2, wherein the second radiating conductor includes a second initial extending portion adjacent to the ground terminal and a second path portion between the second initial extending portion and the third position.

4. The antenna structure as claimed in claim 3, wherein:

the first radiating conductor has a first edge adjacent to the conductor extending portion;

the first path portion has a second edge adjacent to the first edge; and the first gap is formed among the second edge, the first edge, the second initial extending portion, the ground terminal and the conductor extending portion.

5. The antenna structure as claimed in claim 2, wherein:

the signal-feeding terminal and the ground terminal have a feed-in cable connecting reference line therebetween; and the signal-feeding terminal and the first position have a conductor extending path reference line therebetween;

the feed-in cable connecting reference line and the conductor extending path reference line have a reference angle therebetween; and the reference angle is between 120° and 140° .

6. The antenna structure as claimed in claim 5, further comprising:

a first radiating conductor extending portion extending from the first position along the second direction; and the first radiating conductor and the first radiating conductor extending portion have a first bend therebetween, wherein the first bend has a first inner angle larger than 90° .

7. The antenna structure as claimed in claim 6, further comprising a second radiating conductor extending portion extending from the third position along a third direction opposite to the first direction, wherein the second radiating conductor and the second radiating conductor extending portion have a second bend therebetween, wherein the second bend has a second inner angle larger than 90° .

8. The antenna structure as claimed in claim 7, further comprising:

a substrate, wherein the signal-feeding terminal, the ground terminal, the first radiating conductor, the second radiating conductor, the first radiating conductor extending portion, the second radiating conductor extending portion and the conductor extending portion are disposed on the substrate.

9. The antenna structure as claimed in claim 8, further comprising:

a second gap formed among the second radiating conductor, the first radiating conductor and the signal-feeding terminal, and communicating with the first gap;

a third gap formed between the first radiating conductor and the fourth position, and communicating with the first gap;

a fourth gap formed among the second radiating conductor, the first radiating conductor and the first radiating conductor extending portion, and communicating with the second gap; and a fifth gap formed between the second radiating conductor and the second radiating conductor extending portion.

10. The antenna structure as claimed in claim 9, wherein:

the second radiating conductor has a first length measured in a direction perpendicular to the conductor extending portion and parallel to the first radiating conductor extending portion; and the first radiating conductor has a second length measured in a direction parallel to the second radiating conductor extending portion.

11. The antenna structure as claimed in claim 10, wherein the conductor extending portion, the first radiating conductor extending portion and the second radiating conductor extending portion are all quadrilateral.

12. The antenna structure as claimed in claim 11, wherein:

the first radiating conductor extending portion has a third length; and the second radiating conductor extending portion has a fourth length.

13. The antenna structure as claimed in claim 12, wherein the third length is smaller than one-third of the first length.

14. The antenna structure as claimed in claim 12, wherein the fourth length is smaller than one-third of the second length.

15. The antenna structure as claimed in claim 12, wherein the first length, the second length, the third length and the fourth length determine an operating frequency of the antenna structure.

16. The antenna structure as claimed in claim 11, wherein:

the first radiating conductor has a width;

the second edge and the second initial extending portion have a first distance therebetween;

the conductor extending portion and the first edge have a second distance therebetween; the signal-feeding terminal and the second radiating conductor have a third distance therebetween;

a first ratio of the third distance to the first distance is 1/3; and a second ratio of the second distance to the fourth distance is 1/3.

17. The antenna structure as claimed in claim 11, wherein the first radiating conductor is electrically insulated from the second radiating conductor.

18. The antenna structure as claimed in claim 11, wherein the first gap adjusts an impedance matching of the antenna structure.

19. An antenna structure, comprising:

a signal-feeding terminal;

a first radiating conductor extending from the signal-feeding terminal along a first direction to a first position to include a first gradually widening path, and including a first initial extending portion adjacent to the signal-feeding terminal and a first path portion between the first initial extending portion and the first position;

a ground terminal configured to be separated from the signal-feeding terminal by a first gap; and a second radiating conductor extending from the ground terminal along a second direction perpendicular to the first direction to include a second gradually widening path.

20. The antenna structure as claimed in claim 19, wherein the first and second paths are trapezoidal.

* * * * *